US005421465A

United States Patent [19]

Dunner, Jr.

[11] Patent Number: 5,421,465

[45] Date of Patent: Jun. 6, 1995

[54] SUSPENDER RACK APPARATUS

[76] Inventor: Kenneth Dunner, Jr., 10950 Westbrae Pkwy. #6210, Houston, Tex. 77031

[21] Appl. No.: 208,367

[22] Filed: Mar. 10, 1994

[51] Int. Cl.[6] ..... A47F 7/00

[52] U.S. Cl. ..... 211/115; 211/13

[58] Field of Search ..... 211/116, 113, 71, 13, 211/78, 163, 115

[56] References Cited

U.S. PATENT DOCUMENTS

| | | | |
|---|---|---|---|
| D. 165,886 | 2/1952 | Thompon | 211/113 X |
| 2,192,167 | 3/1940 | Bagley et al. | 211/113 |
| 3,993,205 | 11/1976 | Pilchard | 211/116 |
| 4,059,191 | 11/1977 | Chaisson . | |
| 4,366,909 | 1/1983 | Fahmi | 211/116 |
| 4,611,721 | 9/1986 | Heckaman . | |
| 4,759,440 | 7/1988 | Kolton et al. . | |
| 4,765,467 | 8/1988 | Kolton et al. . | |
| 4,863,020 | 9/1989 | Klemow | 211/113 X |
| 4,972,961 | 11/1990 | Roesch | 211/116 |
| 5,071,011 | 12/1991 | Gettig . | |
| 5,224,607 | 7/1993 | Koresko | 211/116 X |

*Primary Examiner*—Alvin C. Chin-Shue
*Assistant Examiner*—Sarah L. Purol

[57] ABSTRACT

A new and improved rack apparatus for storing flexible elongate items, e.g. suspenders, includes a rectangular frame assembly which has a frame length and which is adjacent to a first plane. An array of first rack members is arrayed along a first side of the rectangular frame assembly which also has a frame length. The first rack members project perpendicularly from the first plane and are adjacent to a second plane which is perpendicular to the first plane. A rotatable hook assembly is connected to a second side of the rectangular frame assembly. The second side has a frame length and is opposite to the first side of the rectangular frame assembly. The overall width of the rack apparatus is less than the frame length. An array of second rack members is arrayed along a cross member which spans a third side and a fourth side of the rectangular frame assembly. The third side and the fourth side separate the first side of the rectangular frame assembly and the second side of the rectangular frame assembly from each other. The second rack members project perpendicularly from the first plane and are adjacent to a third plane which is perpendicular to the first plane and parallel to the second plane. The first rack members and the second rack members are substantially parallel to each other.

2 Claims, 4 Drawing Sheets

SUSPENDER RACK APPARATUS

BACKGROUND OF THE INVENTION

Field of the Invention

The present invention relates generally to racks for personal items and, more particularly, to a rack especially adapted for storing suspenders, belts, ties, and other flexible elongate items.

Description of the Prior Art

Many people, especially men, have fairly large numbers of flexible elongate personal items such as suspenders, belts, and ties. Proper storage of large numbers of those personal items presents a problem. Of special interest are racks for supporting large numbers of suspenders.

Throughout the years, a number of innovations have been developed relating to storing flexible elongate personal items, and the following U.S. patents are representative of some of those innovations: U.S. Pat. Nos. 4,059,191; 4,611,721; 4,759,440; 4,765,467; and 5,071,011. More specifically, U.S. Pat. No. 4,059,191 discloses a tie rack that is mounted to a vertical surface such as a door or a wall. Mounting a rack on a door or a wall invariably does some damage to the door or wall. In this respect, it would be desirable if a rack for flexible elongate person items were provided which did not require doing damage to a wall or door for installation.

U.S. Pat. No. 4,611,721 discloses a tie and belt rack that is fixed to a vertical surface doing damage thereto. Moreover, a central spine is provided from which a plurality of ribs project. The ribs project in a direction parallel to the plane of the vertical surface on which the rack is installed. In this respect, this rack takes up a fixed amount of side to side space along the vertical support surface. This device does not provide any variability in side to side space occupied by the rack. When side to side space may be overly congested, it would be desirable if a rack for flexible elongate personal items could vary the amount of side to side space that it occupies.

U.S. Pat. Nos. 4,759,440 and 4,765,467 disclose hangers especially adapted for hanging suspenders. The snaps of the suspenders grip the hangers. The hangers are hung by a fixed hook which may be hung on a transverse bar in a closet. Only one pair of suspenders can be hung from each hanger at a time. Moreover, when a pair of suspenders in not being hung from the hangers, the hanger portions adapted to hold the suspenders are not adaptable to storing flexible elongate personal items that do not have snaps. In this respect, it would be desirable if a rack for flexible elongate person items were provided which has a versatility for storing different types of flexible elongate personal items, not just suspenders that have snaps.

U.S. Pat. No. 5,071,011 discloses a tie rack that is capable of storing a plurality of ties in an array of planes perpendicular to a vertical support surface to which the tie rack is attached. The rack is essentially fixed to the vertical support surface and is highly consumptive of side to side space. As discussed above, being fixedly secured to a vertical support surface and being highly consumptive of side to side space are undesirable features.

Still other features would be desirable in a rack apparatus used for retaining a plurality of flexible elongate personal items. For example, it would be desirable if the storage rack hangs from a transverse rod in a closet. It would also be desirable if a rack for flexible elongate personal items had more than one rack assembly where one rack assembly was positioned above another rack assembly. To provide great flexibility in storing flexible elongate personal items in a closet, it would also be desirable if a rack for such items could be rotated to a variety of angles with respect to the transverse support rod in a closet.

Thus, while the foregoing body of prior art indicates it to be well known to use racks for storing flexible elongate personal items, the prior art described above does not teach or suggest a rack for storing flexible elongate personal items which has the following combination of desirable features:

(1) does not require doing damage to a wall or door for installation;

(2) can vary the amount of side to side space that it occupies; (3) has a versatility for storing different types of flexible elongate personal items, not just suspenders that have snaps;

(4) hangs from a transverse support rod in a closet;

(5) has more than one rack assembly where one rack assembly is positioned above another rack assembly; and (6) can be rotated to a variety of angles with respect to the transverse support rod in a closet.

The foregoing desired characteristics are provided by the unique suspender rack apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a new and improved rack apparatus for storing flexible elongate items which includes a rectangular frame assembly which has a frame length. The rectangular frame assembly is adjacent to a first plane. An array of first rack members is arrayed along a first side of the rectangular frame assembly which also has a frame length. The first rack members project perpendicularly from the first plane. The first rack members are adjacent to a second plane which is perpendicular to the first plane. A rotatable hook assembly is connected to a second side of the rectangular frame assembly. The second side has a frame length and is opposite to the first side of the rectangular frame assembly.

The first rack members are substantially parallel to each other. The first rack members project from a front side of the rectangular frame assembly by a first rack length. The first rack members project from a rear side of the rectangular frame assembly by a second rack length. An overall width is a sum of the first rack length, the second rack length, and a thickness of the rectangular frame assembly. The overall width is less than the frame length.

An array of second rack members is arrayed along a cross member which spans a third side and a fourth side of the rectangular frame assembly. The third side and the fourth side separate the first side of the rectangular frame assembly and the second side of the rectangular frame assembly from each other. The second rack members project perpendicularly from the first plane. The second rack members are adjacent to a third plane which is perpendicular to the first plane and parallel to the second plane. The second rack members are substantially parallel to each other. The second rack members project from a front side of the rectangular frame assembly by a first rack length, and the second rack members project from a rear side of the rectangular frame assembly by a second rack length.

The rotatable hook assembly includes a hook member which includes a flared base end and a beating assembly which receives the flared base end of the hook member. The bearing assembly is connected to the second side.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining a preferred embodiment of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

Further, the purpose of the foregoing Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

It is therefore an object of the present invention to provide a new and improved suspender rack apparatus which has all of the advantages of the prior art and none of the disadvantages.

It is another object of the present invention to provide a new and improved suspender rack apparatus which may be easily and efficiently manufactured and marketed.

It is a further object of the present invention to provide a new and improved suspender rack apparatus which is of durable and reliable construction.

An even further object of the present invention is to provide a new and improved suspender rack apparatus which is susceptible of a low cost of manufacture with regard to both materials and labor, and which accordingly is then susceptible of low prices of sale to the consuming public, thereby making such suspender rack apparatus available to the buying public.

Still yet a further object of the present invention is to provide a new and improved suspender rack apparatus which does not require doing damage to a wall or door for installation.

Still another object of the present invention is to provide a new and improved suspender rack apparatus that can vary the amount of side to side space that it occupies.

Yet another object of the present invention is to provide a new and improved suspender rack apparatus which has a versatility for storing different types of flexible elongate personal items, not just suspenders that have snaps.

Even another object of the present invention is to provide a new and improved suspender rack apparatus that hangs from a transverse support rod in a closet.

Still a further object of the present invention is to provide a new and improved suspender rack apparatus which has more than one rack assembly where one rack assembly is positioned above another rack assembly.

Yet another object of the present invention is to provide a new and improved suspender rack apparatus that can be rotated to a variety of angles with respect to the transverse support rod in a closet.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein.

DESCRIPTION OF THE PREFERRED EMBODIMENT

With reference to the drawings, a new and improved suspender rack apparatus embodying the principles and concepts of the present invention will be described.

Figure 1:
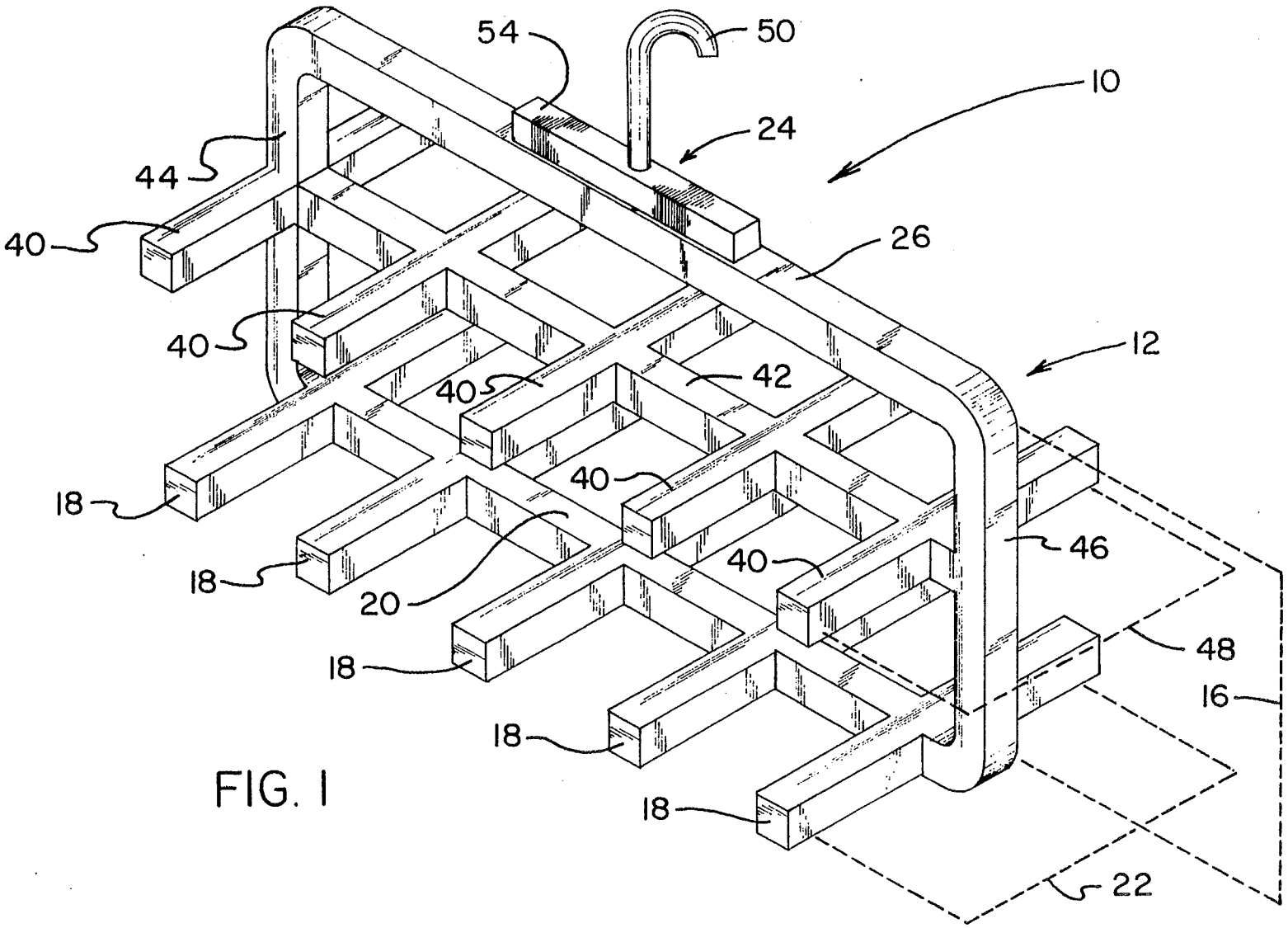
FIG. 1 is a perspective view showing a preferred embodiment of the suspender rack apparatus of the invention.
Figure 2:
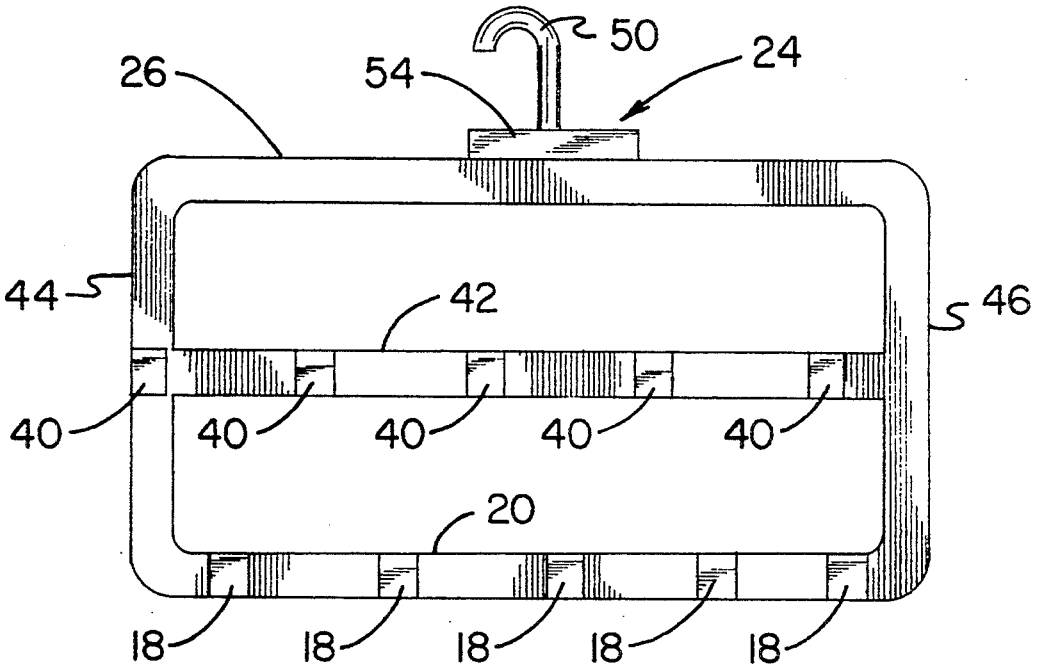
FIG. 2 a side view of the embodiment of the suspender rack apparatus shown in FIG. 1.
Figure 3:
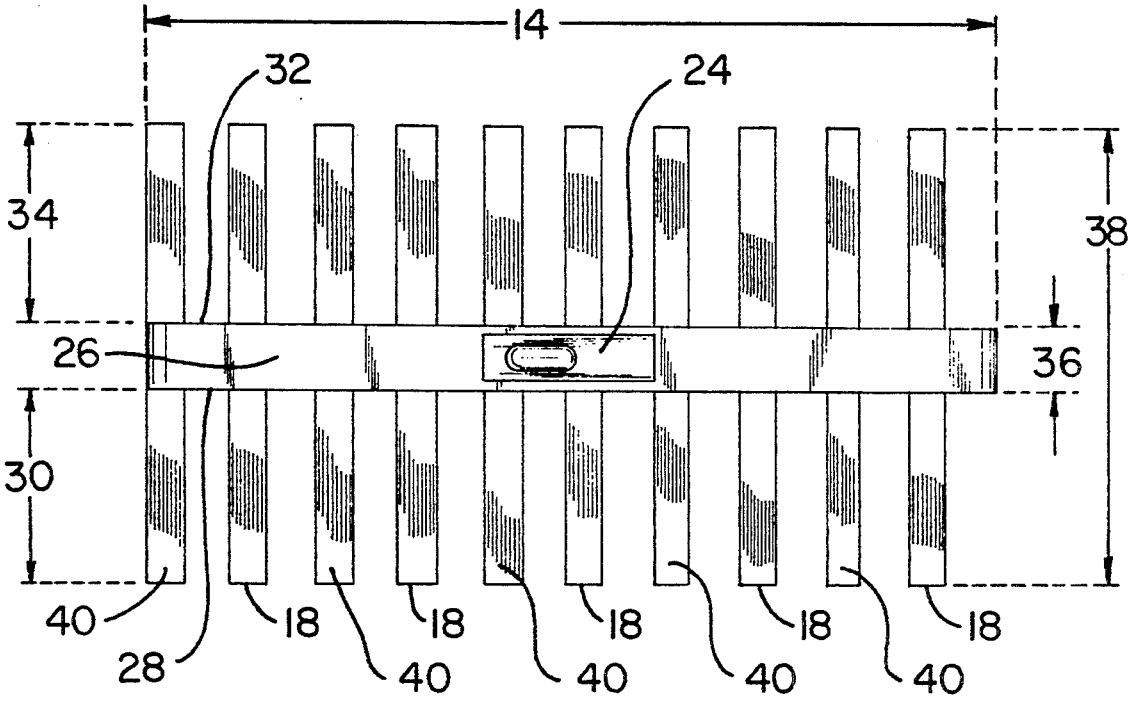
FIG. 3 is a top view of the embodiment of the suspender rack apparatus of FIG. 2.
Figure 4:
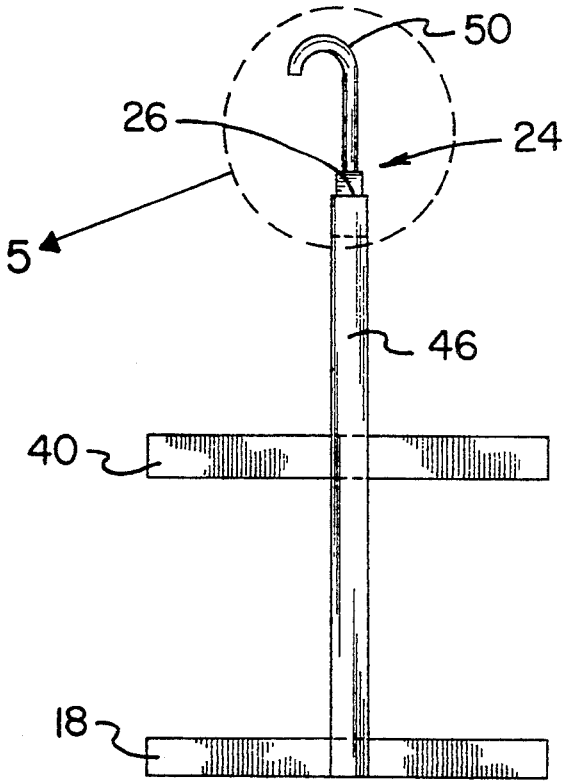
FIG. 4 is a front view of the embodiment of the invention shown in FIG. 2.
Figure 5:
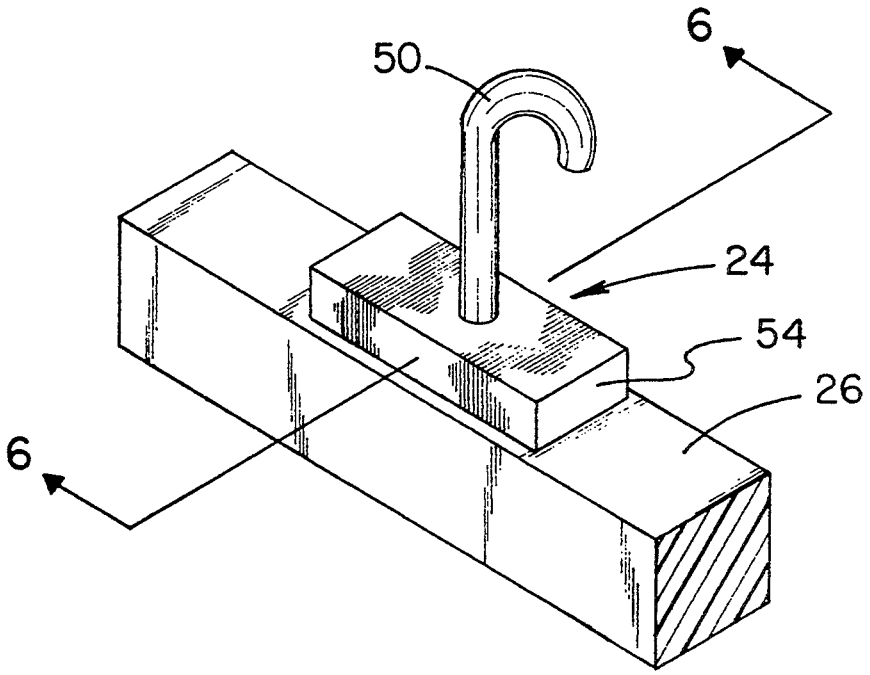
FIG. 5 is an enlarged perspective view of the portion of the embodiment of the invention shown in FIG. 4 that is contained within the circled region 5 in FIG. 4.
Figure 6:
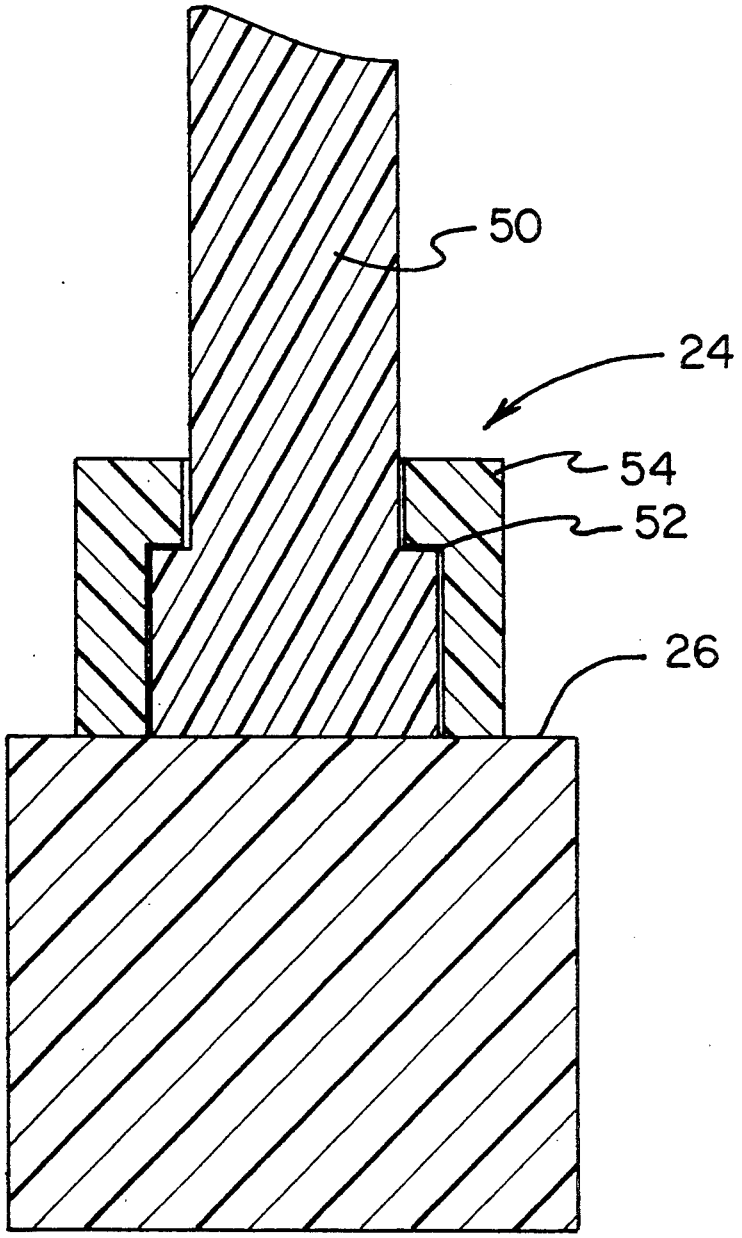
FIG. 6 is an enlarged cross-sectional view of a swivel portion of the rotatable hook shown in FIG. 5.

Turning to FIGS. 1–6, there is shown an exemplary embodiment of the rack apparatus for storing flexible elongate items of the invention which is also referred to herein as a suspender rack apparatus. The rack apparatus of the invention is generally designated by reference numeral 10. In its preferred form, rack apparatus 10 includes a rectangular frame assembly 12 which has a frame length 14. The rectangular frame assembly 12 is adjacent to a first plane 16. An array of first rack members 18 is arrayed along a first side 20 of the rectangular frame assembly 12 which also has a frame length 14. The first rack members 18 project perpendicularly from the first plane 16. The first rack members 18 are adjacent to a second plane 22 which is perpendicular to the first plane 16. A rotatable hook assembly 24 is connected to a second side 26 of the rectangular frame assembly 12. The second side 26 has a frame length 14 and is opposite to the first side 20 of the rectangular frame assembly 12. The flexible elongate personal items such as suspenders, tie, belts, and the like are hung over the first rack members 18 in the manner of towels on a towel rack.

The first rack members 18 are substantially parallel to each other. The first rack members 18 project from a front side 28 of the rectangular frame assembly 12 by a first rack length 30. The first rack members 18 project from a rear side 32 of the rectangular frame assembly 12 by a second rack length 34. An overall width 38 of the first rack members 18 is a sum of the first rack length 30, the second rack length 34, and a thickness 36 of the rectangular frame assembly 12. The overall width 38 is less than the frame length 14.

An array of second rack members 40 is arrayed along a cross member 42 which spans a third side 44 and a fourth side 46 of the rectangular frame assembly 12. The third side 44 and the fourth side 46 separate the first side 20 of the rectangular frame assembly 12 and the second side of the rectangular frame assembly 12 from each other. The second rack members 40 project perpendicularly from the first plane 16. The second rack members 40 are adjacent to a third plane 48 which is perpendicular to the first plane 16 and parallel to the second plane 22. The second rack members 40 are substantially parallel to each other. The flexible elongate personal items such as suspenders, tie, belts, and the like are hung over the second rack members 40 in the manner of towels on a towel rack.

The second rack members 40 project from a front side 28 of the rectangular frame assembly 12 by a first rack length 30, and the second rack members 40 project from a rear side 32 of the rectangular frame assembly 12 by a second rack length 34. An overall width 38 of the second rack members 40 is a sum of the first rack length 30, the second rack length 34, and a thickness 36 of the rectangular frame assembly 12, and the overall width 38 is less than the frame length 14.

The rotatable hook assembly 24 includes a hook member 50 which includes a flared base end 52 and a bearing assembly 54 which receives the flared base end 52 of the hook member 50. The bearing assembly 54 is connected to the second side 26. The bearing assembly 54 includes a bearing surface which is complementarily shaped to the flared base end 52 of the hook member 50 such that the hook member 50 can freely rotate in the bearing assembly 54.

In use, the hook member 50 of the rotatable hook assembly 24 is placed over a transverse rod support (not shown) in a closet, and the rectangular frame assembly 12 can be oriented parallel to the transverse rod support. In this orientation, the suspender rack apparatus of the invention takes up a side to side space in the closet of frame length 14. Alternatively, in a second orientation, the rectangular frame assembly 12 can be rotated around the hook member 50 of the rotatable hook assembly 24 by ninety degrees. In this orientation, the rectangular frame assembly 12 is oriented perpendicular to the transverse rod support. Then, in this orientation, the suspender rack apparatus of the invention takes up a side to side space of the overall width 38 which is less than the frame length 14. If desired, the rectangular frame assembly 12 can be rotated to still another orientation. In this third orientation, the rectangular frame assembly 12 may be oriented at a forty-five degree angle with respect to a corner in a closet. In this orientation, the rectangular frame assembly 12 serves as a hypotenuse of a right triangle wherein a corner of the closet forms the right angle.

Any flexible elongate personal items such as suspenders, ties, belts, and the like can be stored on the first rack members 18 and the second rack members 40 of the invention.

The components of the suspender rack apparatus of the invention can be made from inexpensive and durable metal, plastic, and wooden materials.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved suspender rack apparatus that is low in cost, relatively simple in design and operation, and which may advantageously be used without doing damage to a wall or door for installation. With the invention, a suspender rack apparatus is provided which can vary the amount of side to side space that it occupies. With the invention, a suspender rack apparatus is provided which has a versatility for storing different types of flexible elongate personal items, not just suspenders that have snaps. With the invention, a suspender rack apparatus is provided which hangs from a transverse support rod in a closet. With the invention, a suspender rack apparatus is provided which has more than one rack assembly where one rack assembly is positioned above another rack assembly. With the invention, a suspender rack apparatus is provided which can be rotated to a variety of angles with respect to the transverse support rod in a closet.

With respect to the above description, it should be realized that the optimum dimensional relationships for the pans of the invention, to include variations in size, form function and manner of operation, assembly and use, are deemed readily apparent and obvious to those skilled in the art, and therefore, all relationships equivalent to those illustrated in the drawings and described in the specification are intended to be encompassed only by the scope of appended claims.

While the present invention has been shown in the drawings and fully described above with particularity and detail in connection with what is presently deemed to be the most practical and preferred embodiments of the invention, it will be apparent to those of ordinary skill in the art that many modifications thereof may be made without departing from the principles and concepts set forth herein. Hence, the proper scope of the present invention should be determined only by the broadest interpretation of the appended claims so as to encompass all such modifications and equivalents.

What is claimed as being new and desired to be protected by LETTERS PATENT of the United States is as follows:

1. A new and improved rack apparatus for storing flexible elongate items, comprising:

a rectangular frame assembly having a frame length, said rectangular frame assembly adjacent to a first plane, an array of first rack members arrayed along a first side of said rectangular frame assembly wherein said first side has a frame length, said first rack members projecting perpendicularly from said first plane, said first rack members adjacent to a second plane which is perpendicular to said first plane, wherein said first rack members are substantially parallel to each other, wherein said first rack members project from a front side of said rectangular frame assembly by a first rack length, wherein said first rack members project from a rear side of said rectangular frame assembly by a second rack length, wherein an overall width is a sum of said first rack length, said second rack length, and a thickness of said rectangular frame assembly, and wherein said overall width is less than said frame length, a rotatable hook assembly connected to a second side of said rectangular frame assembly, wherein said second side has a frame length and is opposite to said first side of said rectangular frame assembly, and an array of second rack members arrayed along a cross member which spans a third side and a fourth side of said rectangular frame assembly, wherein said third side and said fourth side separate said first side of said rectangular frame assembly and said second side of said rectangular frame assembly from each other, wherein said second rack members project perpendicularly from said first plan, and wherein said second rack members are adjacent to a third plane which is perpendicular to said first plane and parallel to said second plane, wherein said second rack members are substantially parallel to each other, wherein second rack members project from a front side of said rectangular frame assembly by a first rack length, and wherein said second rack members project from a rear side of said rectangular frame assembly by a second rack length.

2. The apparatus described in claim 1 wherein said rotatable hook assembly includes:

a hook member which includes a flared base end, and a bearing assembly Which receives said flared base end of said hook member, said bearing assembly connected to said second side of said rectangular frame assembly.

* * * * *